US007465204B2

(12) United States Patent
Schloegel

(10) Patent No.: US 7,465,204 B2
(45) Date of Patent: Dec. 16, 2008

(54) LIFE RAFT

(75) Inventor: Christian Schloegel, Avignonet de Lauragais (FR)

(73) Assignee: Zodiac International (FR)

( * ) Notice: Subject to any disclaimer, the term of this patent is extended or adjusted under 35 U.S.C. 154(b) by 0 days.

(21) Appl. No.: 11/630,652

(22) PCT Filed: Jun. 21, 2005

(86) PCT No.: PCT/FR2005/001555

§ 371 (c)(1),
(2), (4) Date: Dec. 22, 2006

(87) PCT Pub. No.: WO2006/010808

PCT Pub. Date: Feb. 2, 2006

(65) Prior Publication Data

US 2007/0270059 A1 Nov. 22, 2007

(30) Foreign Application Priority Data

Jun. 25, 2004 (FR) ..... 04 07026

(51) Int. Cl.
*B63B 35/58* (2006.01)
*B63B 7/00* (2006.01)

(52) U.S. Cl. ..... 441/40; 114/345

(58) Field of Classification Search ..... 441/40
See application file for complete search history.

(56) References Cited

U.S. PATENT DOCUMENTS

| | | | | |
|---|---|---|---|---|
| 2,396,212 | A | 3/1946 | Spanel | |
| 3,659,298 | A | 5/1972 | Edwards | |
| 5,800,225 | A * | 9/1998 | Shoaff, III | 441/38 |
| 6,666,124 | B2 * | 12/2003 | Fleming | 89/36.12 |
| 7,032,258 | B2 * | 4/2006 | O'Hanlon | 4/487 |

FOREIGN PATENT DOCUMENTS

| | | |
|---|---|---|
| DE | 19928792 | 12/1999 |
| GB | 2338931 | 1/2000 |

* cited by examiner

*Primary Examiner*—Jesús D Sotelo
(74) *Attorney, Agent, or Firm*—Dean W. Russell; Kilpatrick Stockton LLP

(57) ABSTRACT

The inventive inflatable life raft comprises a peripheral pneumatic float (1) and a bottom (2) fixed thereto and is characterised in that a mechanically résistant belt (4) extends along the float (1) circumference, is fixed thereto along the entire length thereof and said belt (4) bears or incorporâtes fixing means (8) for at least one towing line in such a way that towing forces are distributed through the entire circumference of the float and the raft can withstand high towing forces without any damages.

14 Claims, 2 Drawing Sheets

LIFE RAFT

CROSS REFERENCE TO RELATED APPLICATIONS

This application is the U.S. national phase of International Application No. PCT/FR2005/001555 filed on Jun. 21, 2005 and published as International Publication No. WO 2006/010808 A1, which application claims priority to French Patent Application No. 04 07026 filed on Jun. 25, 2004, the contents of which are incorporated by reference herein.

FIELD OF THE INVENTION

The present invention relates to improvements to life rafts of inflatable type comprising a peripheral pneumatic float and a bottom fixed to said float.

BACKGROUND OF THE INVENTION

Life rafts must be able to be towed by means of towing lines. To this end, life rafts are equipped with a member, such as a ring or the like, appropriate for attaching the end of the towing line. This ring is usually fixed to the wall of the float via a loop made of a flexible material which in turn is fixed (e.g. by adhesive bonding or welding) to the float wall.

An arrangement of the above type is in principle relatively reliable and sufficient to withstand typically a tractive force of around 500 kgf which was formerly required for rafts intended for pleasure craft.

However, the problem with such an arrangement is that the entirety of the tractive force is applied to the wall of the float in a very localized manner at one or two points and its reliability depends entirely on the mechanical strength of the fixings and of the wall. In practice, there have been incidents in which the attachment of the towing line has failed due to detachment of the ring retention loop or local tearing of the float wall.

It is also prior art to attach the towing line to a lashing hung garland-fashioned around the periphery of the float. The problem with this approach is that the lashing is engaged loosely through loops and is not rigidly fixed to the float itself. The tensile force applied to the lashing is thus transferred to the float in an irregular way at local points of the float (loops, fixings of the ends of the lashing), and there is still a risk of failure or tearing under heavy loads. Furthermore, if the lashing fails the towing option is lost.

New standards now require not only that rafts be able to withstand even greater towing forces (approximately 800 to 1000 kgf for pleasure rafts) but also that towing be unaffected by lashing failure. Currently known life raft arrangements fail to meet these new requirements in any certain and reliable way.

BRIEF DESCRIPTION OF THE INVENTION

It is therefore an object of the invention to provide an improved life raft structure that satisfies practical demands better than is currently the case.

To these ends, the invention provides a life raft of inflatable type comprising a peripheral pneumatic float and a bottom fixed to said float, which raft, being constructed in accordance with the invention, is characterized in that a belt having good mechanical strength extends all the way around the periphery of the float and is fixed to the latter all the way along its length and in that this belt supports or incorporates fixing means for at least one towing line.

With this improved structure, towing forces are no longer applied to individual points of the float but are taken by the belt only. This belt is in the general shape of a loop which encircles the float in such a way that, during towing, it is the belt which is pulled and the towing forces are not communicated at any time to the float. By selecting a belt which has the appropriate mechanical strength, the raft becomes able to withstand very high towing forces without damage.

In one possible embodiment, the belt may be made of a material suitable for adhesively bonding or welding directly to the outer face of the float.

However, in a preferred embodiment, the belt is made of woven or braided material and is stitched to a strip of substrate which in turn is made of a material suitable for adhesively bonding or welding to the outer face of the float. Thus produced in woven or braided form, the belt is less prone to tearing and its mechanical tensile strength is increased.

It is preferable for the belt to be formed by two half-belts encircling two respective half-peripheries of the float. This configuration will make it easier to fix the belt to the float because it avoids the necessity of grappling with one piece of too great a length when attaching it.

Advantageously, there is provided in the vicinity of each end of the belt or half-belts a loop or ring suitable for receiving the end of at least one towing line.

Advantageously again, it is a good idea to make use of the presence of the belt and have an external lashing fixed at intervals to the belt, and even, in addition to this, to have external raft accessories (handles, rings, a flexible ladder, etc.) fixed to the belt.

The arrangements of the invention can have a particularly useful application where the float is made up of at least two superposed inflatable tubes and the two tubes are held at a distance from each other and connected together by a strip of intermediate material, in which case the belt is advantageously fixed to the outer face of said intermediate strip between the two tubes. The advantage of this option is that the belt is not attached directly to a pneumatic part and can therefore be treated as a simple mechanical member of the raft, particularly as regards the fixing of the accessories which can admittedly be stitched on as explained earlier, but can also be attached by other mechanical means such as staples, threaded fasteners, rivets, etc.

To implement the above configuration, the float may be made from a sheet of material whose longitudinal edges are folded and fixed, facing each other, along the middle of the sheet, leaving said intermediate strip between them; or the float may be made from a tube of material whose diametrically opposite longitudinal portions are pinched together and fixed to each other in such a way as to define said intermediate strip.

In this case the belt may advantageously be made of a woven or braided material and may be stitched to the outer face of the intermediate strip. It is then possible for internal raft accessories to also be fixed, and in particular stitched, to said belt through the intermediate strip.

In a raft of generally round configuration, the invention provides that the two half-belts described above extend between two diametrically opposite parts of said intermediate strip. Similarly, in a raft of generally quadrilateral configuration, such as a square, the invention provides that each half-belt extends along two consecutive sides, the corresponding loops for attaching a towing line being situated near each other on each side of the corner formed by the float.

An additional advantage of the provisions of the invention should be stressed here, namely that it is possible to make the float of the raft from a composite material consisting of a layer of watertight synthetic material sandwiched between two textile layers, the advantage of such a material being its excellent flexibility and hence the ease with which it can be folded and stored in a container; besides which, such a material is less expensive than the materials usually employed. However, the outer textile layer is unsuitable for welding an accessory or an accessory support, such as a ring for attaching a towing line; and although adhesive bonding is still possible, the mechanical strength of adhesive bonding is insufficient to withstand a large tensile force such as can occur during towing. The provisions of the invention therefore allow the use of the above composite material to be reconciled with high mechanical strength of the float under tensile forces.

BRIEF DESCRIPTION OF THE DRAWINGS

The invention will be better understood with the detailed description which is now given of certain preferred embodiments presented purely by way of illustrative examples. This description refers to the accompanying drawings, in which.

DETAILED DESCRIPTION OF THE INVENTION

Figure 1:
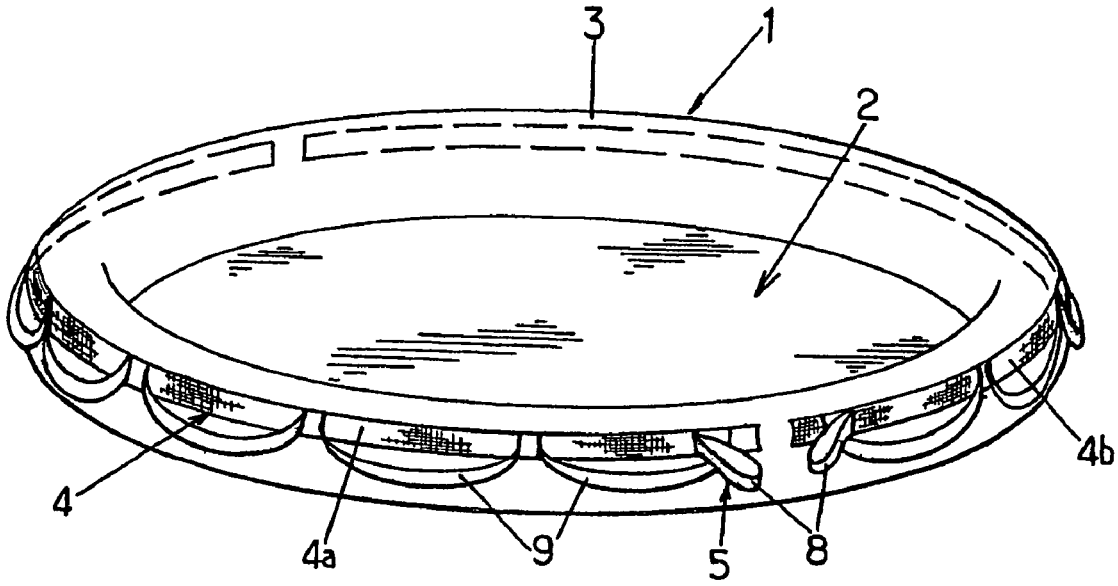
FIG. 1 is a schematic perspective view of a life raft equipped in accordance with the invention.

Referring initially to FIG. 1, this shows an inflatable life raft comprising a pneumatic float 1 running around the periphery and a flexible bottom 2 fixed underneath the float 1. In this example, the float 1 is a single inflatable tube 3 and is generally circular.

The invention provides that a belt 4 having good mechanical strength extends all the way around the periphery of the float 1 and is fixed to it all the way along its length, and that this belt 4 supports or incorporates fixing means 5 for at least one towing line.

In this arrangement, towing forces are taken by the belt alone: this belt is in the general form of a loop running around the float in such a way that, during towing, it is the belt that is towed and that pulls the float which it encircles, no part of the float being at any time subjected to traction. By selecting a belt that possesses the appropriate mechanical strength, the raft is thus able to withstand very high towing forces without damage.

The belt may take the form of a strip of strong material, notably a synthetic material, which may be adhesively bonded or welded directly to the outer face of the flexible wall of the float, provided that this outer face will accept the adhesive bond or weld. If there is incompatibility in respect of direct adhesion or welding of the two materials, it is possible to envision interposing one or more intermediate strips of another material.

Figure 2:
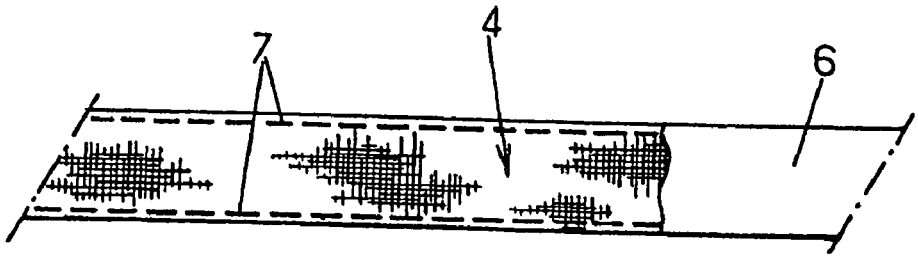
FIG. 2 is a schematic of a length of belt suitable for equipping the raft of FIG. 1 in accordance with the invention.

In a preferred embodiment, as shown in FIG. 2, the belt 4 is made of woven or braided material and is stitched (at 7) to a strip of substrate 6 which in turn is made of a material suitable for adhesively bonding or welding to the outer face of the float 1.

Conceptually, the belt 4 must extend all the way around the periphery of the float 1 so that the raft has the desired strength in a towing situation.

However, during manufacture, handling so great a length of belt may cause problems and interfere with the assembly process; furthermore, fixing the belt to the float may be accompanied by localized deformations and/or contraction of the belt which could complicate the assembly process along too great a length.

To avoid these problems it is preferable to provide two half-belts 4*a*, 4*b*, which are simpler to handle and easier to fix, which extend around two respective half-peripheries of the float 1, as shown in FIG. 1. In the configuration of a round raft envisioned here, the two half-belts extend in semicircles and their respective ends come together at two diametrically opposite points of the float 1.

To facilitate the attachment of the end of a towing line, it is advantageous to design the aforementioned fixing means 5 in the form of a loop 8 attached (stitched) to the belt or formed by the belt itself in the process of fixing it. The loop would be situated in the vicinity of each end of the belt or half-belts. Another possibility would be to fix a ring to the belt for this purpose.

The presence of the belt 4 on the periphery of the float offers the possibility of fixing to it various raft accessories, and more particularly those which come under strain. This is more especially the case of the outer lashing 9 which, in the context of the invention, is stitched to the belt 4 at intervals in such a way as to give the usual pattern of a garland, as shown in FIG. 1. It may also be appropriate for other accessories which are stitched to the belt 4, such as for example a flexible ladder for climbing onboard, a floating anchor, water bags, etc.

Figure 3:
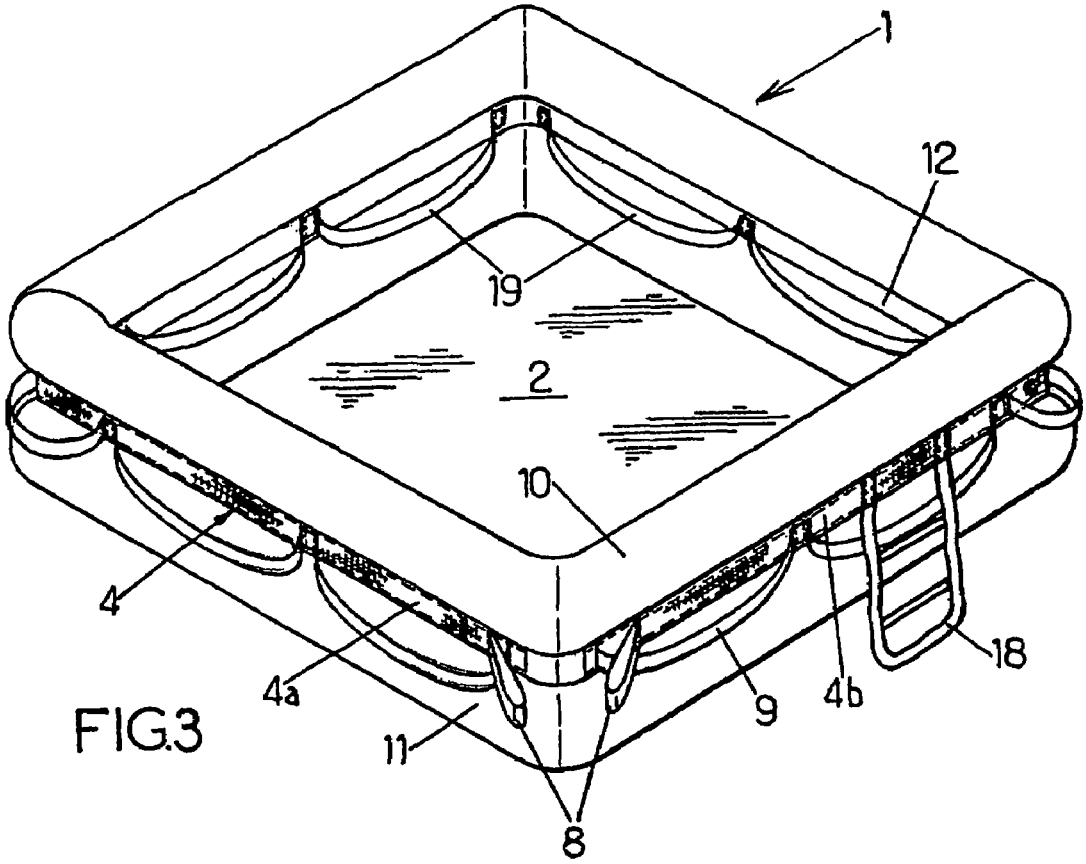
FIG. 3 is a schematic perspective view of a preferred embodiment of a raft fitted out in accordance with the invention.

The use of a belt in accordance with the invention can have a beneficial application to a particular life raft structure, specifically rafts in which the float 1 is made up of at least two superposed inflatable tubes 10, 11 held at a distance from each other and connected together by an intermediate strip 12 of flexible material, as shown in FIG. 3 which shows as an example a raft of quadrilateral (in this case square) shape. In this case it is an advantage for the belt 4 to be fixed to the outer face of said intermediate strip 12 between the two tubes 10, 11.

To make such a float, various options may be considered.

Figure 4A:
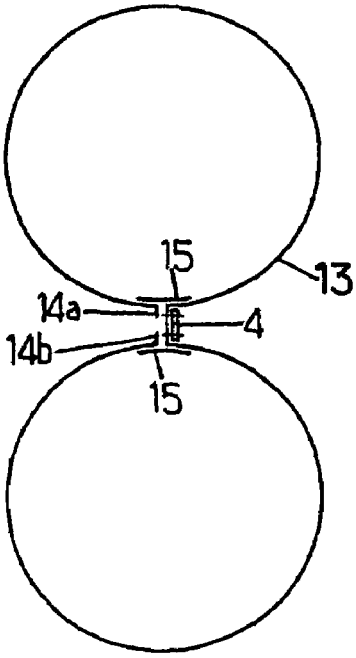
FIGS. 4A and 4B are schematics of the cross section through one side of the raft of FIG. 3 showing two possible structures of the raft corresponding to two different forms of manufacture.

One option, shown diagrammatically in FIG. 4A, is to make the float 1 or a length of the float 1 (such as one side of the raft) from a single sheet of material 13 whose opposite longitudinal edges 14*a*, 14*b* are folded and fixed (e.g. by adhesive bonding), facing each other, along the middle of the sheet to define two tubes, leaving said intermediate strip between them. Two internal reinforcements 15 can preferably be inserted and fixed (e.g. by adhesive bonding) inside the tubes along the joins. The belt 4 is fixed to the outer face of the intermediate strip 12 either before or after these assembly operations.

Figure 4B:
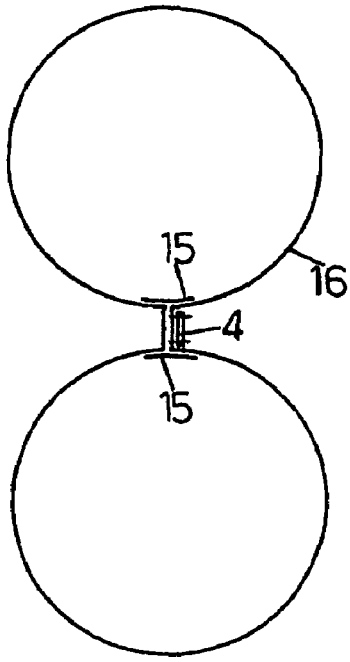

Another option, illustrated diagrammatically in FIG. 4B, is to make the float 1 or a length of the float 1 (such as one side of the raft) from a tube 16 of material whose diametrically opposite longitudinal portions are pinched together and fixed (e.g. by adhesive bonding) to each other in such a way as to define said intermediate strip 12. Two internal reinforcements 15 can preferably be inserted and fixed (e.g. by adhesive bonding) inside the tubes along the joins. Here again, the belt 4 is fixed to the outer face of the intermediate strip 12 either before or after these assembly operations.

The intermediate strip does not need to be of great height and in practice a height of a few centimeters (for example, typically some 5 cm) may suffice. The belt will in that case be of approximately the same height.

In a preferred embodiment of the provisions of the invention applied to a raft as shown in FIG. 3, the belt 4 is made of a woven or braided material and is stitched to the outer face of the intermediate strip 12. Being a raft of generally quadrilateral shape, such as a square as illustrated in this FIG. 3, each half-belt 4*a*, 4*b* extends along two consecutive sides. In this case the two loops 8 formed by the half-belts or attached to them are situated in the vicinity of a corner of the raft. FIG. 3 shows an example in which an outer lashing 9 is stitched like a garland at intervals onto the half-belts, and the ends of a flexible ladder 18 are stitched to one of the half-belts. Many accessories could conceivably be fixed in the same way to the outside of the raft.

In the raft configuration more particularly envisioned in relation to FIG. 3, the intermediate strip 12 is a simple structural element without relation to the pneumatic part: it is therefore possible to treat it as a simple mechanical member. On this basis, it is conceivable for accessories inside the raft also to be fixed, notably by stitching them, to said belt through the intermediate strip. Thus, the figure shows, purely as an example, an internal lashing 19 stitched at intervals to the belt 4 on the inside of the intermediate strip 12, but of course many other accessories can be fixed in the same way so as to be in reach of the user.

The invention claimed is:

1. A life raft of inflatable type comprising a peripheral pneumatic float and a bottom fixed to said float, wherein the float is made up of at least two superposed inflatable tubes held at a distance from each other and connected together by an intermediate strip of flexible material, wherein a belt having good mechanical strength extends all the way around the periphery of the float and is rigidly fixed to an outer face of the intermediate strip between the two tubes all the way along its length, and wherein the belt supports or incorporates fixing means for at least one towing line, whereby towing forces are distributed all the way around the periphery of the float and the raft is able to withstand very high towing forces without damage.

2. The life raft as claimed in claim 1, wherein the belt is made of a material suitable for adhesively bonding or welding directly to the outer face of the intermediate strip of the float.

3. The life raft as claimed in claim 1, wherein the belt is made of woven or braided material and is stitched to a strip of substrate which in turn is made of a material suitable for adhesively bonding or welding to the outer face of the intermediate strip of the float.

4. The life raft as claimed in claim 1, wherein the belt is formed by two half-belts encircling two respective half-peripheries of the intermediate strip of the float.

5. The life raft as claimed in claim 4, said life raft being of generally round shape and wherein the two half-belts extend between two diametrically opposite parts of said intermediate strip.

6. The life raft as claimed in claim 4, said life raft being of generally quadrilateral shape and wherein each half-belt extends along two consecutive sides.

7. The life raft as claimed in claim 4, wherein a loop or ring suitable for receiving the end of at least one towing line is provided in the vicinity of each end of the half-belts.

8. The life raft as claimed in claim 1, wherein a loop or ring suitable for receiving the end of at least one towing line is provided in the vicinity of each end of the belt.

9. The life raft as claimed in claim 1, wherein an external lashing is fixed at intervals to the belt.

10. The life raft as claimed in claim 1, wherein external raft accessories are fixed to the belt.

11. The life raft as claimed in claim 1, wherein the float is made from a sheet of material whose longitudinal edges are folded and fixed, facing each other, along the middle of the sheet, leaving said intermediate strip between them.

12. The life raft as claimed in claim 1, wherein the float is made from a tube of material whose diametrically opposite longitudinal portions are pinched together and fixed to each other in such a way as to define said intermediate strip.

13. The life raft as claimed in claim 1, wherein the belt is made of a woven or braided material and is stitched to the outer face of the intermediate strip.

14. The life raft as claimed in claim 13, wherein internal raft accessories are fixed to said belt through the intermediate strip.

* * * * *